US012716264B2

(12) United States Patent
Carpenter

(10) Patent No.: US 12,716,264 B2
(45) Date of Patent: Aug. 25, 2026

(54) FENCING GUN ASSEMBLY

(71) Applicant: Doug Carpenter, Bonanza, OR (US)

(72) Inventor: Doug Carpenter, Bonanza, OR (US)

( * ) Notice: Subject to any disclaimer, the term of this patent is extended or adjusted under 35 U.S.C. 154(b) by 275 days.

(21) Appl. No.: 18/529,779

(22) Filed: Dec. 5, 2023

(65) Prior Publication Data

US 2025/0179832 A1 Jun. 5, 2025

(51) Int. Cl.
*E04H 17/26* (2006.01)
*E04H 17/10* (2006.01)

(52) U.S. Cl.
CPC ..... *E04H 17/268* (2013.01); *E04H 17/124* (2021.01)

(58) Field of Classification Search
CPC ... E04H 17/268; E04H 17/124; B25B 27/146; B21F 15/06
See application file for complete search history.

(56) References Cited

U.S. PATENT DOCUMENTS 5,217,049 A 6/1993 Forsyth
5,613,530 A 3/1997 Kincel
5,881,452 A * 3/1999 Nowell, III ..... B25B 27/146 29/816
5,938,099 A 8/1999 Ciccarelli
8,347,472 B2 * 1/2013 Nanjo ..... B25B 31/00 29/243.5
D935,866 S 11/2021 Chaudet
11,174,656 B1 11/2021 Goedecke
2006/0243340 A1 11/2006 Wheeler
2009/0158809 A1 * 6/2009 Murayama ..... B25B 27/146 72/409.03

FOREIGN PATENT DOCUMENTS

WO WO1999015286 4/1999

* cited by examiner

*Primary Examiner* — Teresa M Ekiert

(57) ABSTRACT

A fencing gun assembly includes a fencing gun that has a handle, a trigger movably integrated into the handle, a barrel and a grapple attached to the barrel. The grapple has a pair of gripping elements and a fence post can be positioned between the gripping elements. A cartridge is removably attachable to the barrel of the fencing gun which stores a plurality of fencing clips. The fencing gun shoots a single fencing clip outwardly through the barrel when the fencing gun is actuated. The pair of gripping elements bends the single fencing clip around the fence post and the fence wire thereby securing the fence wire to the fence post.

5 Claims, 7 Drawing Sheets

FENCING GUN ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to fencing devices and more particularly pertains to a new fencing device for automatically fastening a fence wire to a fence post. The device includes a fencing gun which has a grapple to engage the fence wire. The device includes a cartridge which stores a plurality of fencing clips and the cartridge is insertable into the fencing gun. The fencing gun shoots the fencing clips and the grapple forces the fencing clips to bend around the fence wire and the fence post for attaching the fence wire to the fence post.

(2) Description of Related Art Including Information Disclosed Under 37 CFR 1.97 and 1.98

The prior art relates to fencing devices including a power tool device which includes a pair of jaws that are rotatable about a common axis for wrapping a wire tie around rebar. The prior art discloses a twist tie device that includes a spool mounted to a housing which has a pair of spaced grips. The prior art discloses a wire clip gun that includes a pair of grips that are each disposed on a barrel of a clip gun and which are closable together for bending a wire clip around a pair of intersecting members. The prior art discloses a fence clip tool that includes a pair of fingers that bend a wire clip around a fence post. The prior art discloses an ornamental design for a vine tying machine that includes a gun, a spool rotatably attached to the gun and a finger curving downwardly in front of the gun.

BRIEF SUMMARY OF THE INVENTION

An embodiment of the disclosure meets the needs presented above by generally comprising a fencing gun that has a handle, a trigger movably integrated into the handle, a barrel and a grapple attached to the barrel. The grapple has a pair of gripping elements and a fence post can be positioned between the gripping elements. A cartridge is removably attachable to the barrel of the fencing gun which stores a plurality of fencing clips. The fencing gun shoots a single fencing clip outwardly through the barrel when the fencing gun is actuated. The pair of gripping elements bends the single fencing clip around the fence post and the fence wire thereby securing the fence wire to the fence post.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
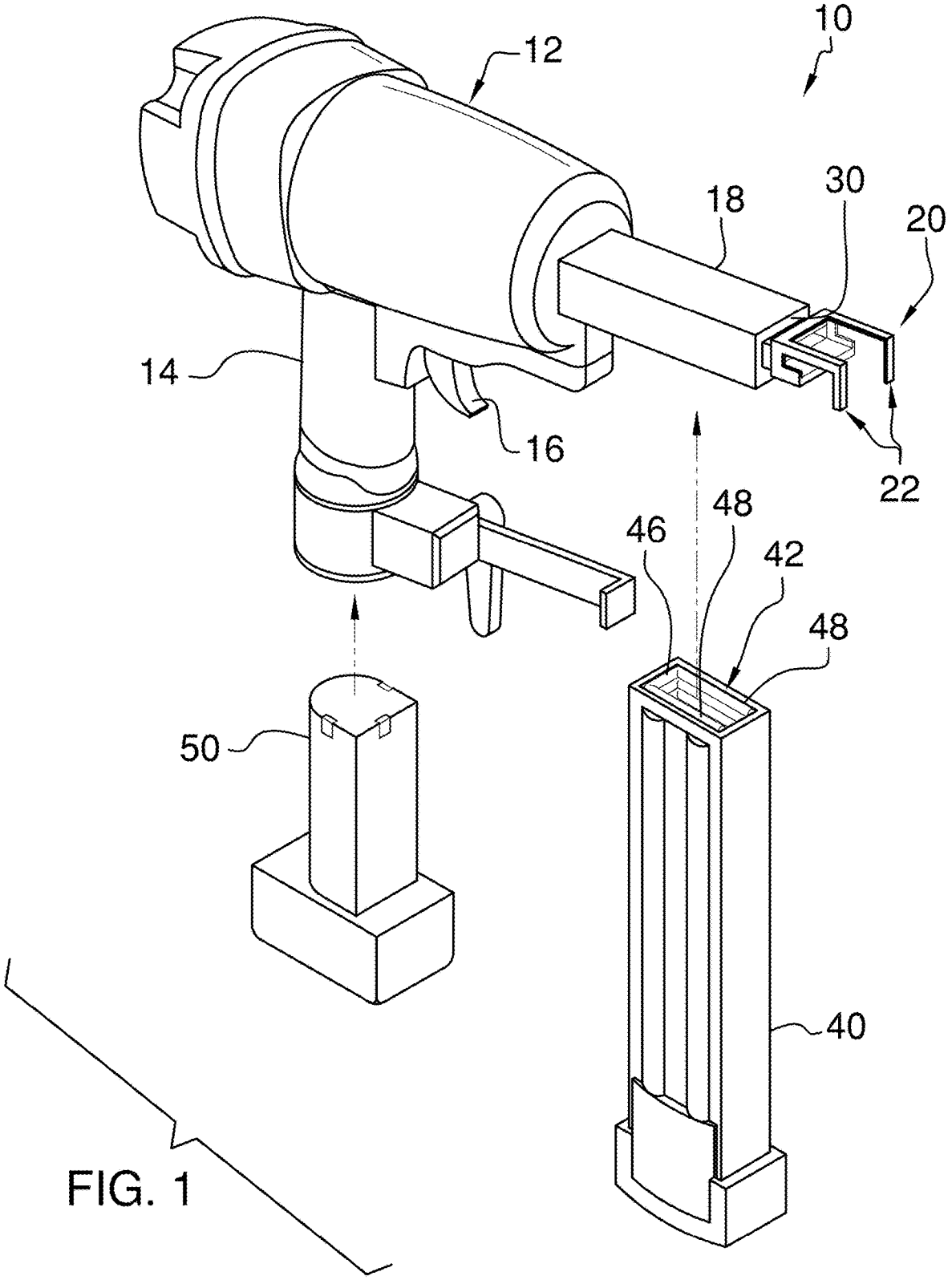
FIG. 1 is an exploded perspective view of a fencing gun assembly according to an embodiment of the disclosure.
Figure 2:
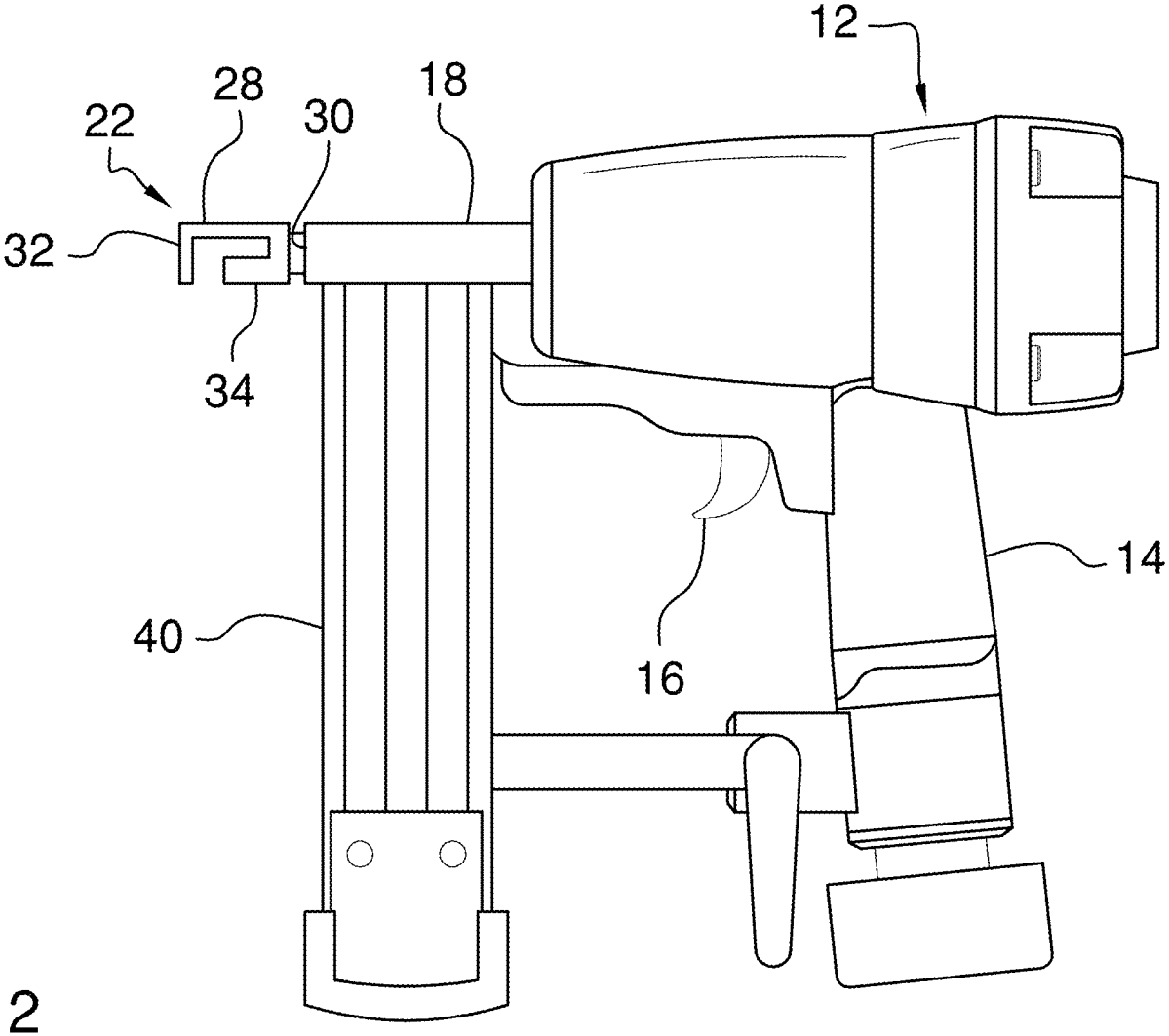
FIG. 2 is a left side view of an embodiment of the disclosure.
Figure 3:
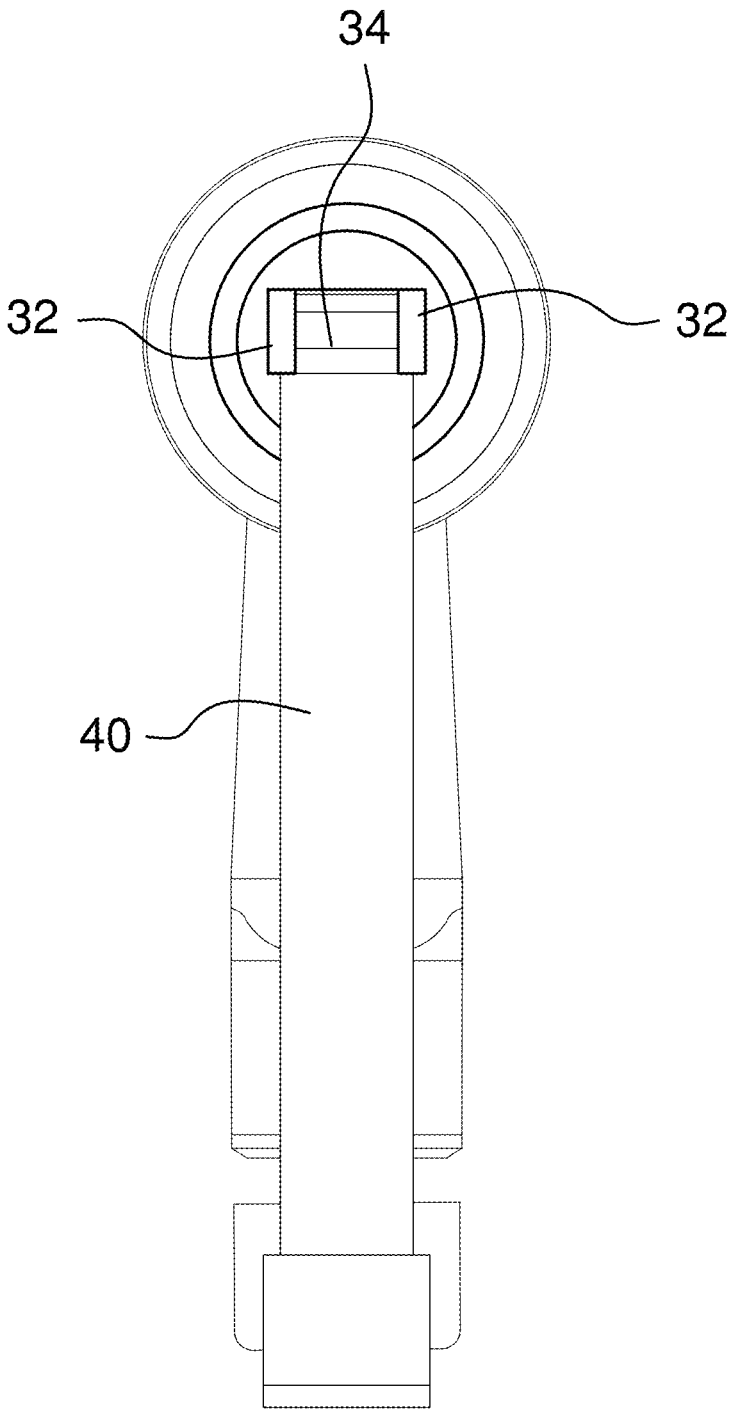
FIG. 3 is a front view of an embodiment of the disclosure.
Figure 4:
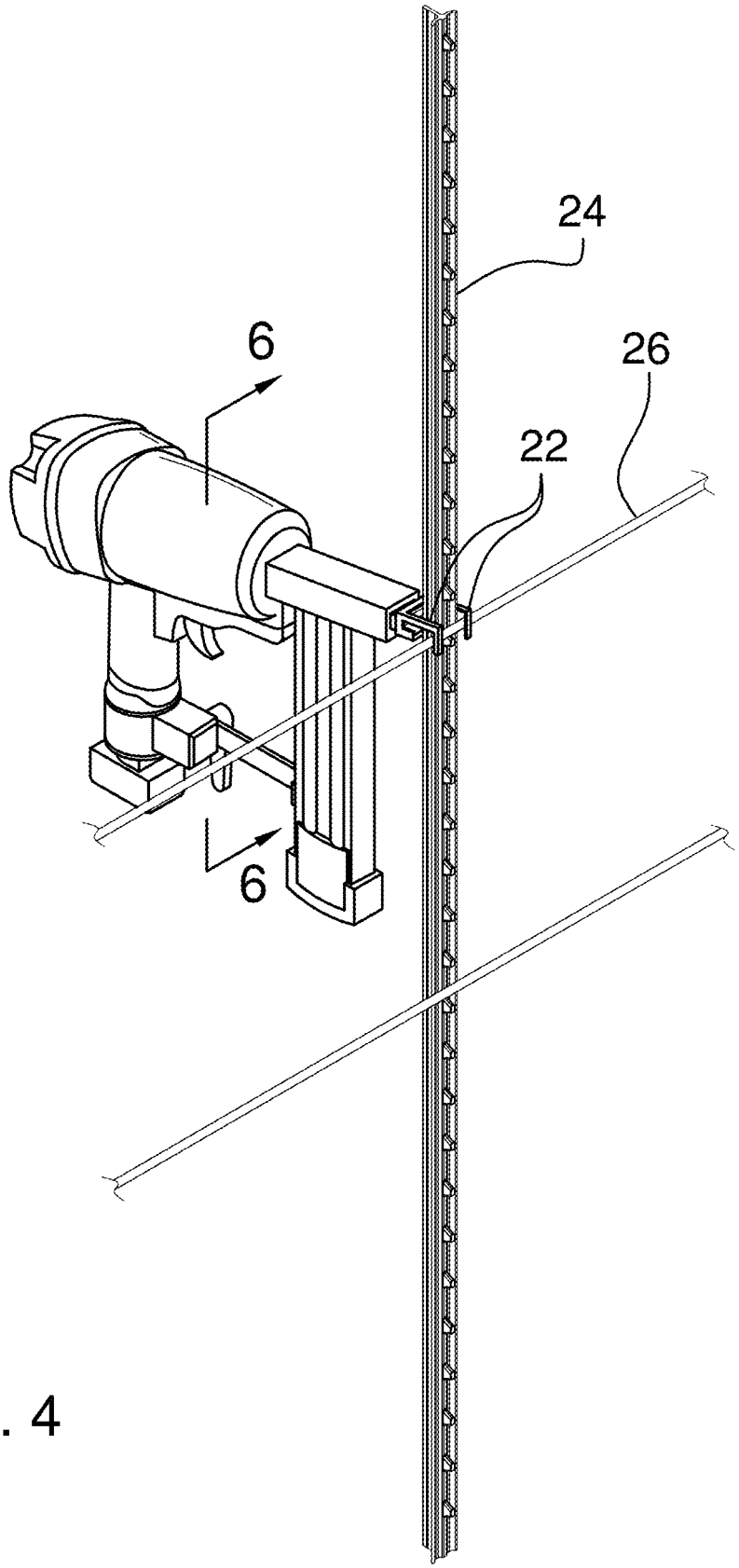
FIG. 4 is a perspective in-use view of an embodiment of the disclosure showing a pair of gripping elements being positioned to grip a fence wire against a fence post.
Figure 5:
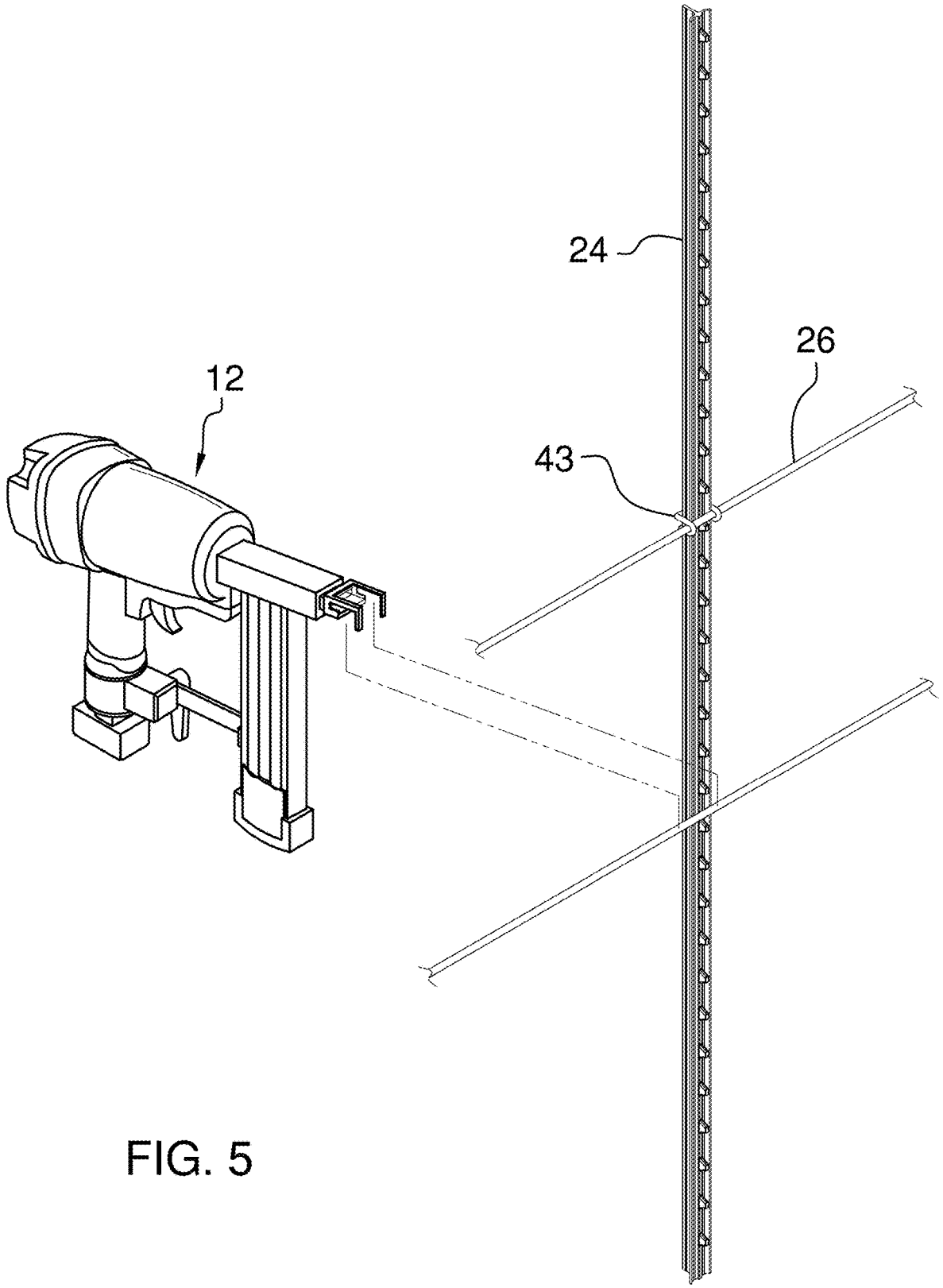
FIG. 5 is a perspective in-use view of an embodiment of the disclosure showing a fence clip being bent around a fence wire and a fence post.
Figure 6A:
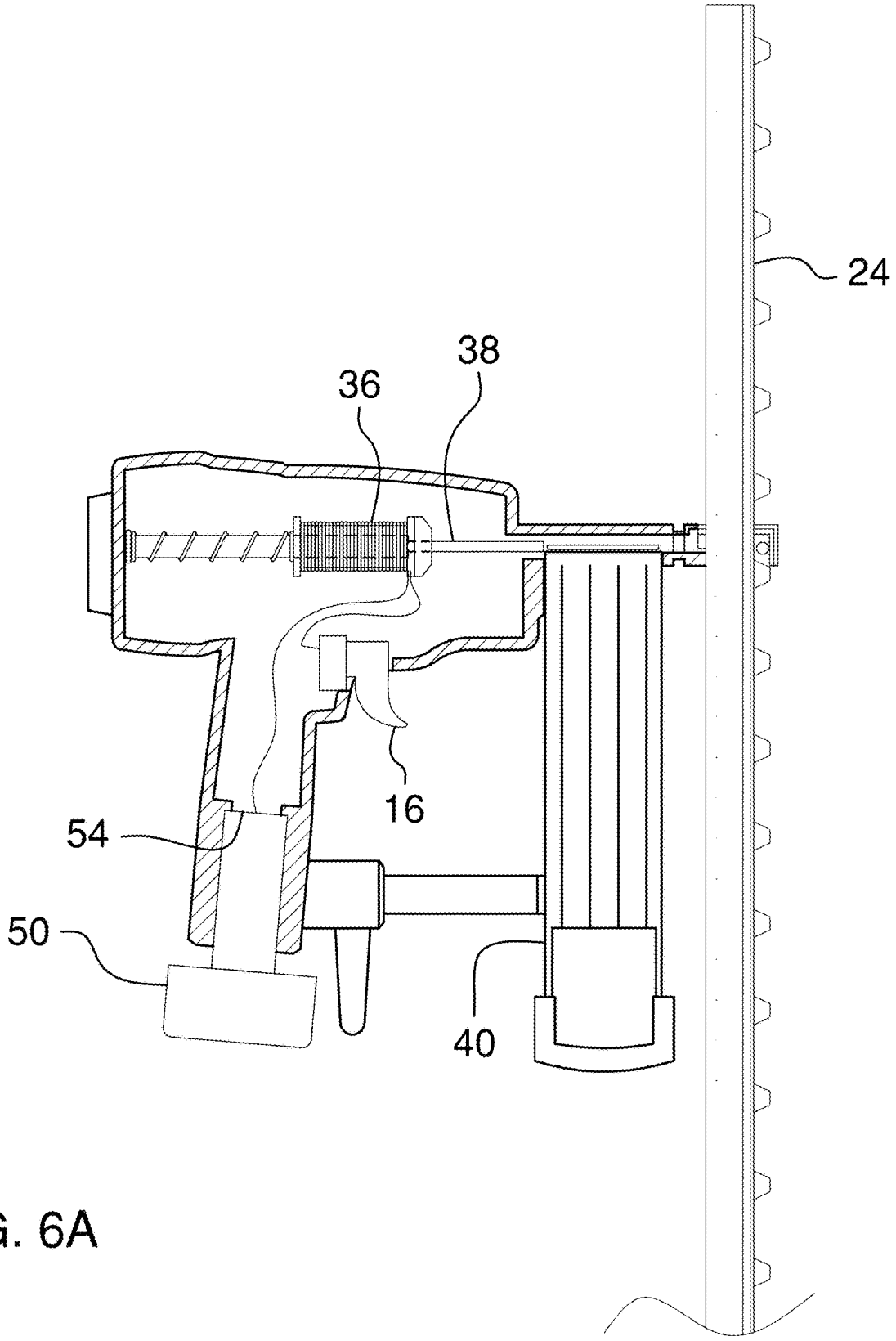
FIG. 6A is a cross sectional view taken along line 6-6 of FIG. 4 of an embodiment of the disclosure which shows an actuator being turned off.
Figure 6B:
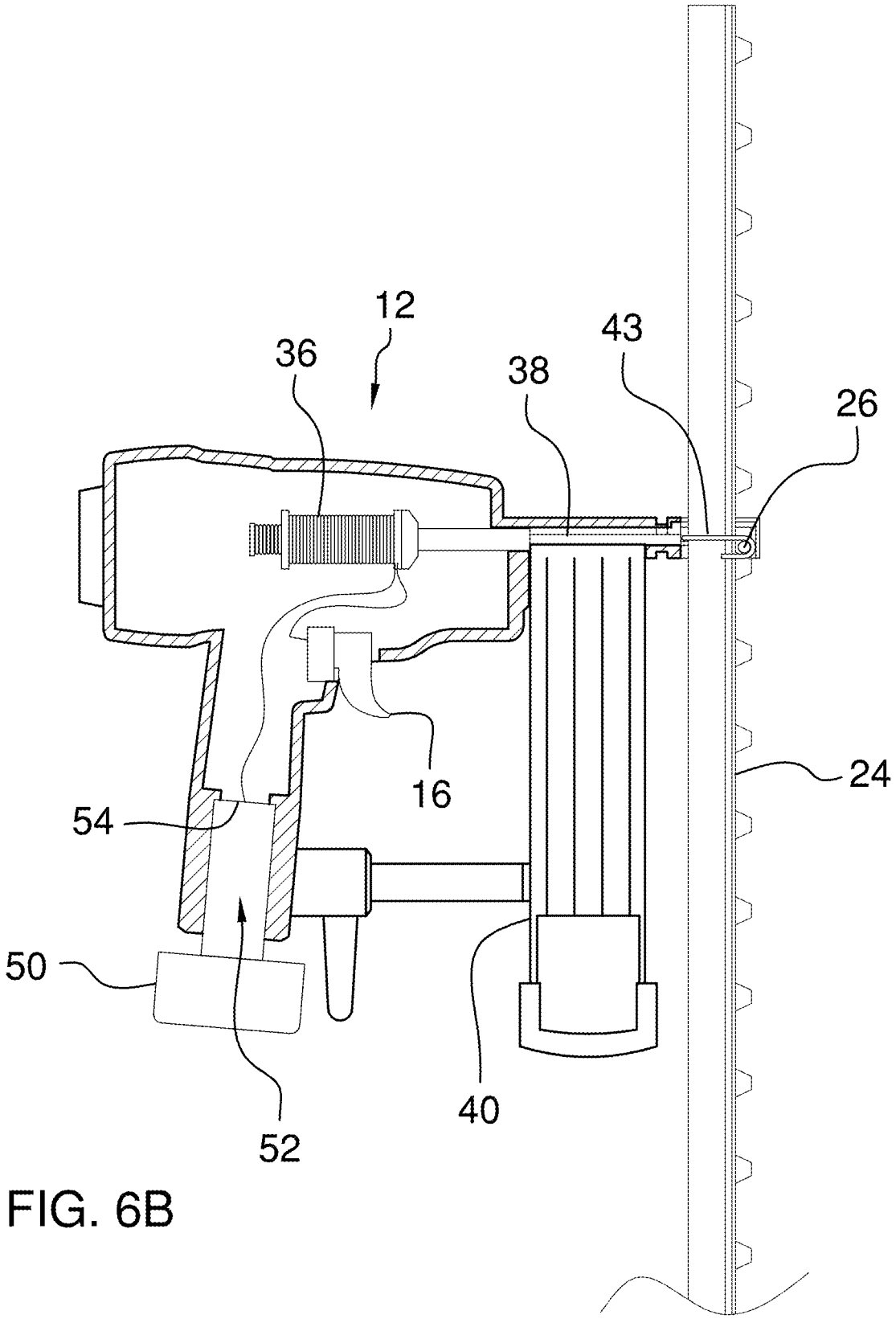
FIG. 6B is a cross sectional view taken along line 6-6 of FIG. 4 of an embodiment of the disclosure which shows an actuator being turned on and a fence clip being bent around a fence wire and a fence post.

With reference now to the drawings, and in particular to FIGS. 1 through 6B thereof, a new fencing device embodying the principles and concepts of an embodiment of the disclosure and generally designated by the reference numeral 10 will be described.

As best illustrated in FIGS. 1 through 6B, the fencing gun assembly 10 generally comprises a fencing gun 12 has a handle 14, trigger 16 movably integrated into the handle 14, a barrel 18 and a grapple 20 attached to the barrel 18. The grapple 20 has a pair of gripping elements 22 that are spaced apart from each other to facilitate a fence post 24 to be positioned between the gripping elements 22 having the gripping elements 22 gripping a fence wire 26 against the fence post 24. The fencing gun 12 is actuated each time the trigger 16 is pulled. Each of the gripping elements 22 includes a leg 28 extending away from a distal end 30 of the barrel 18 and a foot 32 extending downwardly from the leg 28. The foot 32 associated with each of the gripping elements 22 is spaced from the distal end 30 of the barrel 18. Furthermore, the grapple 20 includes a tray 34 that is positioned beneath the pair of gripping elements 22. The tray 34 lies on a plane that is oriented perpendicular to the foot 32 associated with each of the gripping elements 22 and the tray 34 is spaced from the foot 32 associated with each of the gripping elements 22.

The fencing gun 12 includes an actuator 36 that is positioned within the fencing gun 12 and a piston 38 that is disposed in the actuator 36. The actuator 36 urges the piston 38 into an extended position having the piston 38 extending into the barrel 18 when the actuator 36 is turned on. The actuator 36 biases the piston 38 into a retracted position having the piston 38 being displaced from the barrel 18 when the actuator 36 is turned off. The actuator 36 is electrically coupled to the trigger 16 and the actuator 36 is turned on when the trigger 16 is depressed. Conversely, the actuator 36 is turned off a predetermined time after the actuator 36 is turned on. The actuator 36 may comprise an electromagnetic solenoid, a linear electromechanical actuator or any other type of actuator that can produce linear motion.

A cartridge 40 is included and the cartridge 40 is removably attachable to the barrel 18 of the fencing gun 12. The cartridge 40 stores a plurality of fencing clips 42 and the fencing gun 12 urges a single one of the plurality of fencing clips 43 outwardly through the barrel 18 when the fencing gun 12 is actuated. The pair of gripping elements 22 forces the single fencing clip 43 to be bent into a curve when the fencing gun 12 is actuated. In this way the fencing gun 12 can bend the single fencing clip 43 around the fence post 24 and the fence wire 26 thereby securing the fence wire 26 to the fence post 24. The fence post 24 may be a T-post and the fence wire 26 may be barbed wire, straight wire or any other type of fence wire 26 that is commonly employed to construct fencing.

Each of the fencing clips 42 has a central member 46 extending between a pair of outward members 48. The piston 38 abuts the central member 46 of the single fencing clip 43 when the actuator 36 is turned on thereby urging the single fencing clip 43 outwardly through the barrel 18 and onto the tray 34 of the grapple 20. Each of the outward members 48 of the single fencing clip 43 abuts the foot 32 associated with each of the gripping elements 22 thereby forcing each of the outward members 48 to curve rearwardly toward the distal end 30 of the barrel 18. In this way the single fencing clip 43 attaches the fence wire 26 to the fence post 24 having each of the outward members 48 being wrapped around the fence wire 26 and having the central member 46 abutting the fence post 24.

A power supply 50 is provided and the power supply 50 is removably insertable into a well 52 in the handle 14 of the fencing gun 12. The power supply 50 is placed into electrical communication with an electrical contact 54 that is integrated into the handle 14. Additionally, the electrical contact 54 is electrically coupled to the trigger 16 thereby facilitating the power supply 50 to be in electrical communication with the actuator 36 when the trigger 16 is pulled. The power supply 50 may comprise a rechargeable battery such as a lithium ion battery or other rechargeable battery that is commonly associated with cordless power tools.

In use, the fencing clips 42 are loaded into the cartridge 40 in a stacked orientation and the cartridge 40 is loaded into the fencing gun 12. The fencing gun 12 is positioned such that the fence post 24 is positioned between the pair of gripping elements 22 and the foot 32 associated with each of the gripping elements 22 extends downwardly in front of the fence wire 26. The trigger 16 is pulled to shoot a single fencing clip 43 outwardly into the gripping elements 22. The foot 32 associated with each of the gripping elements 22 forces the outward members 48 of the single fencing clip 43 to curve around the fence wire 26 and the central member 46 is abutted against the fence post 24. In this way the fencing clips 42 are automatically wrapped around the fence wire 26 and the fence post 24 for securing the fence wire 26 to the fence post 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fencing gun assembly for automatically installing a clip on a fence post, said assembly comprising:

a fencing gun having a handle, a trigger being movably integrated into said handle, a barrel and a grapple attached to the barrel, said grapple having a pair of gripping elements being spaced apart from each other wherein said pair of gripping elements is configured to facilitate the fence post to be positioned between said gripping elements having said gripping elements gripping a fence wire against the fence post, said fencing gun being actuated each time said trigger is pulled;

a cartridge being removably attachable to said barrel of said fencing gun, said cartridge storing a plurality of fencing clips, said fencing gun urging a single one of said plurality of fencing clips outwardly through said barrel when said fencing gun is actuated, said pair of gripping elements forcing said single fencing clip to be bent into a curve when said fencing gun is actuated wherein said fencing gun is configured to bend said single fencing clip around the fence post and the fence wire thereby securing the fence wire to the fence post; and wherein each of said gripping elements includes a leg extending away from a distal end of said barrel and a foot extending downwardly from said leg, said foot associated with each of said gripping elements being spaced from said distal end of said barrel, said grapple including a tray being positioned beneath said pair of gripping elements, said tray lying on a plane being oriented perpendicular to said foot associated with each of said gripping elements, said tray being spaced from said foot associated with each of said gripping elements.

2. The assembly according to claim 1, wherein said fencing gun includes an actuator being positioned within said fencing gun and a piston being disposed in said actuator, said actuator urging said piston into an extended position having said piston extending into said barrel when said actuator is turned on, actuator biasing said piston into a retracted position having said piston being displaced from said barrel when said actuator is turned off, said actuator being electrically coupled to said trigger, said actuator being turned on when said trigger is depressed, said actuator being turned off a predetermined time after said actuator is turned on.

3. The assembly according to claim 2, wherein each of said fencing clips has a central member extending between a pair of outward members, said piston abutting said central member of said single fencing clip when said actuator is turned on thereby urging said single fencing clip outwardly through said barrel and onto said tray of said grapple, each of said outward members of said single fencing clip abutting said foot associated with each of said gripping elements thereby forcing each of said outward members to curve rearwardly toward said distal end of said barrel wherein said single fencing clip is configured to attach the fence wire to the fence post having each of said outward members wrapped around the fence wire and having said central member abutting the fence post.

4. The assembly according to claim 2, further comprising a power supply being removably insertable into a well in said handle of said fencing gun, said power supply being placed into electrical communication with a contact being integrated into said handle, said contact being electrically coupled to said trigger thereby facilitating said power supply to be in electrical communication with said actuator when said trigger is pulled.

5. A fencing gun assembly for automatically installing a clip on a fence post, said assembly comprising:

a fencing gun having a handle, a trigger being movably integrated into said handle, a barrel and a grapple attached to the barrel, said grapple having a pair of gripping elements being spaced apart from each other wherein said pair of gripping elements is configured to facilitate the fence post to be positioned between said gripping elements having said gripping elements gripping a fence wire against the fence post, said fencing gun being actuated each time said trigger is pulled, each of said gripping elements including a leg extending away from a distal end of said barrel and a foot extending downwardly from said leg, said foot associated with each of said gripping elements being spaced from said distal end of said barrel, said grapple including a tray being positioned beneath said pair of gripping elements, said tray lying on a plane being oriented perpendicular to said foot associated with each of said gripping elements, said tray being spaced from said foot associated with each of said gripping elements, said fencing gun including an actuator being positioned within said fencing gun and a piston being disposed in said actuator, said actuator urging said piston into an extended position having said piston extending into said barrel when said actuator is turned on, actuator biasing said piston into a retracted position having said piston being displaced from said barrel when said actuator is turned off, said actuator being electrically coupled to said trigger, said actuator being turned on when said trigger is depressed, said actuator being turned off a predetermined time after said actuator is turned on;

a cartridge being removably attachable to said barrel of said fencing gun, said cartridge storing a plurality of fencing clips, said fencing gun urging a single one of said plurality of fencing clips outwardly through said barrel when said fencing gun is actuated, said pair of gripping elements forcing said single fencing clip to be bent into a curve when said fencing gun is actuated wherein said fencing gun is configured to bend said single fencing clip around the fence post and the fence wire thereby securing the fence wire to the fence post, each of said fencing clips having a central member extending between a pair of outward members, said piston abutting said central member of said single fencing clip when said actuator is turned on thereby urging said single fencing clip outwardly through said barrel and onto said tray of said grapple, each of said outward members of said single fencing clip abutting said foot associated with each of said gripping elements thereby forcing each of said outward members to curve rearwardly toward said distal end of said barrel wherein said single fencing clip is configured to attach the fence wire to the fence post having each of said outward members wrapped around the fence wire and having said central member abutting the fence post; and a power supply being removably insertable into a well in said handle of said fencing gun, said power supply being placed into electrical communication with a contact being integrated into said handle, said contact being electrically coupled to said trigger thereby facilitating said power supply to be in electrical communication with said actuator when said trigger is pulled.

* * * * *